United States Patent [19]

Hasker et al.

[11] Patent Number: 5,064,397

[45] Date of Patent: Nov. 12, 1991

[54] METHOD OF MANUFACTURING SCANDATE CATHODE WITH SCANDIUM OXIDE FILM

[75] Inventors: Jan Hasker; Jacobus E. Crombeen; Petrus A. M. Van Dorst; Johannes Van Esdonk; Pieter Hokkeling; Josef J. Van Lith, all of Eindhoven, Netherlands

[73] Assignee: U.S. Philips Corporation, New York, N.Y.

[21] Appl. No.: 482,140

[22] Filed: Feb. 16, 1990

[30] Foreign Application Priority Data

Mar. 29, 1989 [NL] Netherlands ..... 8900765

[51] Int. Cl.[5] ..... H01J 9/04

[52] U.S. Cl. ..... 445/50

[58] Field of Search ..... 445/50, 51; 313/346 R, 313/346 DC

[56] References Cited

U.S. PATENT DOCUMENTS

| | | | |
|---|---|---|---|
| 4,594,220 | 6/1986 | Hasker et al. | 313/346 R |
| 4,625,142 | 11/1986 | van Esdonk | 313/346 DC |
| 4,626,470 | 12/1986 | Yamamoto et al. | 428/336 |
| 4,873,052 | 10/1989 | Hasker et al. | 419/2 |

*Primary Examiner*—Kenneth J. Ramsey

*Attorney, Agent, or Firm*—Norman N. Spain

[57] ABSTRACT

For maintaining a monolayer of scandium which is necessary for a satisfactory emission on the surface of a scandate cathode, at least the top layer of the cathode is provided with scandium coated with a scandium oxide film. Even after repeated ion bombardment the emission is found to recover up to approximately 90% of the initial value at a current density of ca. 100 A/cm$^2$.

15 Claims, 2 Drawing Sheets

METHOD OF MANUFACTURING SCANDATE CATHODE WITH SCANDIUM OXIDE FILM

BACKGROUND OF THE INVENTION

The invention relates to a scandate cathode having a cathode body which comprises a matrix of at least a high-melting point metal and/or alloy with a barium compound at least in the matrix in contact with the matrix material, which compound can supply barium to the emissive surface by a chemical reaction with the matrix material.

The invention also relates to methods of manufacturing such a cathode and to an electron beam tube provided with such a cathode.

Cathodes of the type mentioned in the opening paragraph are described in the article "Properties and manufacture of top layer scandate cathodes", Applied Surface Science 26 (1986), pp. 173–195, J. Hasker, J. van Esdonk and J. E. Crombeen. In the cathodes described in this article scandium oxide ($Sc_2O_3$) grains of several microns or tungsten (W) grains which are partially coated with either scandium (oxidation occurs during impregnation in the latter cathodes) (Sc) or scandium hydride ($ScH_2$) (oxidation occurs during impregnation in the latter cathodes) are present at least in the top layer of the cathode body. The cathode body is manufactured by pressing and sintering, whereafter the pores are impregnated with barium-calcium-aluminate. In order to maintain the electron emission, the barium-calcium-aluminate supplies barium on the emissive surface by a chemical reaction with the tungsten of the matrix during operation of the cathode. To be able to realise a very high cathode load in, for example a cathode ray tube, it is important that a scandium-containing layer having a thickness of approximately one monolayer be formed on the cathode surface during impregnation by means of a reaction with the impregnating agent. As has been proved in experiments described in the above-mentioned article, the scandium-containing layer may be completely or partly removed by an ion bombardment which may occur in practice, for example during the manufacture of television tubes, which remova leads to detrimental consequences for the electron emission. Since $Sc_2O_3$ is not very mobile the said scandium-containing layer cannot be fully regenerated by reactivation of the cathode. The described experiments have also proved that a regeneration which is sufficient for a complete recovery of the emission is not achieved. As compared with an impregnated tungsten cathode coated or not coated with, for example osmium, this may be considered as a drawback.

OBJECTS AND SUMMARY OF THE INVENTION

One of the objects of the invention is to provide scandate cathodes which are considerably improved in comparison with the above-mentioned drawback. The invention is based on the recognition that this can be achieved by using diffusion of scandium through scandium oxide.

To this end a scandate cathode according to the invention is characterized in that at least the top layer of the cathode body comprises scandium which is coated with a scandium oxide film.

When raising the temperature in vacuo, scandium is diffused to the exterior from the said grains through the scandium oxide film.

The scandate cathode may be of the impregnated type in which the barium compound is introduced into the cathode body by means of impregnation, but alternatively the cathode may be a pressed scandate cathode or an L cathode.

A method of manufacturing an impregnated cathode according to the invention is characterized in that a matrix is pressed from scandium powder and a powder of the high-melting point metal (for example, tungsten), whereafter the scandium powder is partly oxidized and the assembly is subsequently sintered and impregnated. The scandium may be obtained by dehydration of scandium hydride.

In another method according to the invention, before sintering and impregnation, a matrix is pressed from the high-melting point metal, and from scandium coated with a scandium oxide film. The latter is obtained by partial oxidation beforehand of scandium and/or scandium hydride.

The increase in weight due to oxidation of the scandium(hydride) is preferably at least 5% and at most 30%. In the case of a smaller increase, the oxide film is too thin or incomplete, whereas the oxide film will be too thick for the diffusion process or too much scandium is lost in the case of a larger increase in weight. Similar restrictions apply to the oxidation of the scandium after pressing.

In the case of previous oxidation the pressure should not be too high (for example $<1000^N/mm^2$) so as to prevent the oxide film from breaking, which results in a loss of the above-described effect.

In the case of sintering at high temperatures scandium is lost by evaporation. To avoid this as much as possible, the sintering operation is preferably performed in hydrogen (approximately 1 atmosphere) at temperatures up to approximately 1500° C.

To limit the effect of unfavourable reactions between impregnating agent and scandium to a maximum possible extent (for example, to limit formation of scandium oxide so that the scandium supply after ion bombardment is not detrimentally influenced), the impregnation temperature is chosen to be as low as possible. At a lower temperature the quantity of impregnating agent which is taken up decreases with increasing quantities of scandium or scandium hydride in so-called mixed matrix cathodes in which the scandium coated with scandium oxide is present throughout the matrix. The quantity of scandium or scandium hydride is therefore preferably limited to at most 2.5% by weight in the mixture to be pressed.

Another method is characterized in that the cathode is obtained by mixing, pressing and subsequent sintering of powders of a high-melting point metal and/or alloy and scandium, scandium hydride, or scandium coated with a scandium oxide film, together with the powder of a barium compound which can supply barium on the emissive surface by a chemical reaction with the high-melting point metal and/or alloy during operation of the cathode. In this method the sintering temperature is the highest temperature ever acquired by the cathode body. This temperature may be substantially lower than the impregnation temperature which is conventionally used in the method described hereinbefore.

BRIEF DESCRIPTION OF THE DRAWINGS

The invention will now be described in greater detail with reference to the accompanying drawings in which.

DESCRIPTION OF THE PREFERRED EMBODIMENTS

Figure 1:
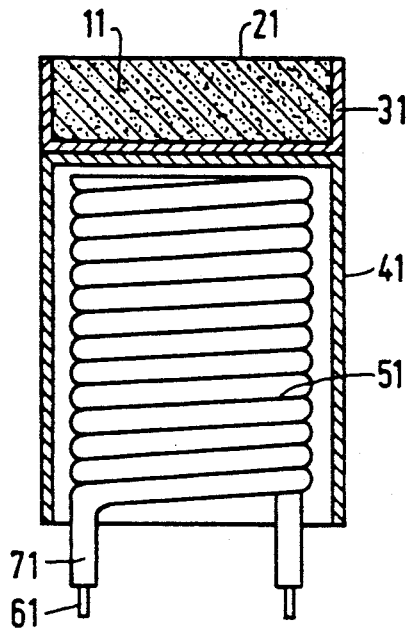
FIG. 1 shows diagrammatically a cathode according to the invention.

FIG. 1 is a longitudinal section of a scandate cathode according to the invention. The cathode body 11 with an emissive surface 21 and a diameter of, for example 1.8 mm, is obtained by pressing a matrix from W powder and a powder of scandium hydride (approximately 0.7% by weight) or scandium, heating for a number of hours in wet argon at approximately 800° C. so as to provide the scandium with an oxide film, and sintering at 1500° C. in, for example a hydrogen atmosphere. The thickness of the matrix is then approximately 0.5 mm. The cathode body which is subsequently impregnated and which may or may not have an envelope 31 is welded onto the cathode shaft 41. A helical cathode filament 51, which may comprise a helically wound metal core 61 with an aluminum oxide insulation layer 71 is present in the shaft 41. The emission of such a cathode, after mounting and activation, is measured in a diode arrangement, under pulse loading and at a cathode temperature (brightness temperature) of 950° C.

Figure 2:
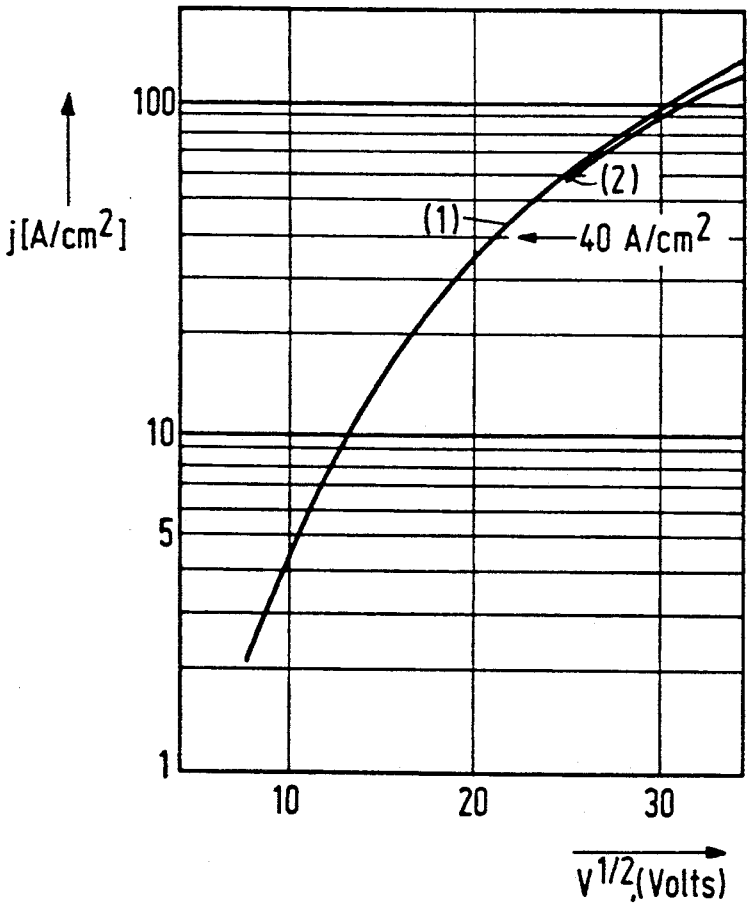
FIG. 2, 3 and 4 show the results of measurements on several cathodes graphically as emission j in A/cm$^2$ on a log scale versus potential V in Volts on a linear scale.

Curve 1 of FIG. 2 shows the results of such emission measurements measured on a cathode according to the invention for a cathode-anode gap of 0.25 mm. Curve 2 shows the results of emission measurements after the cathode has been subsequently exposed to an argon ion bombardment and reactivation, as described in the article referred to in the opening paragraph.

Figure 3:
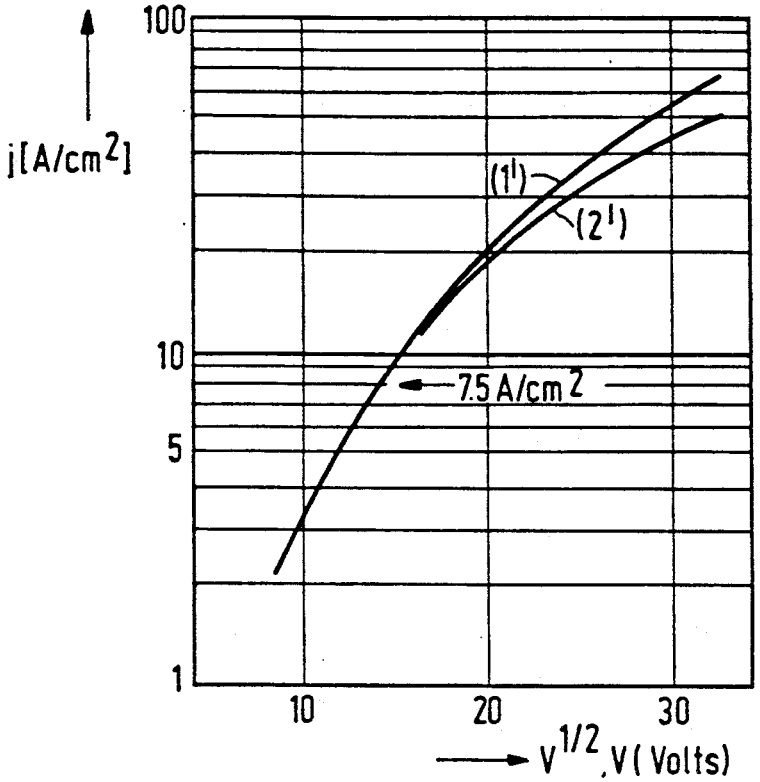
Figure 4:
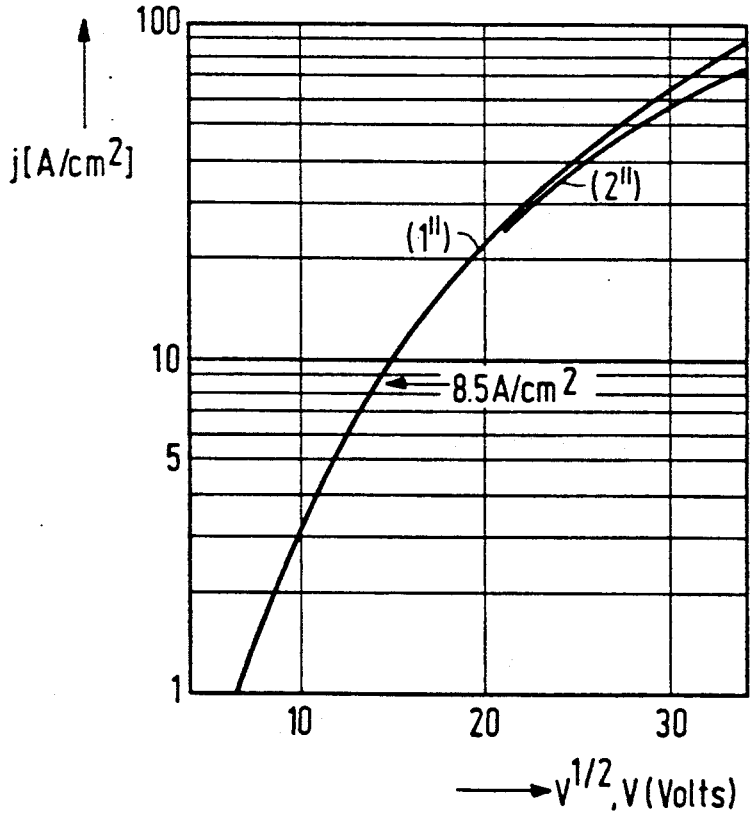

FIG. 3 shows similar results of such measurements on a cathode in which the above-mentioned oxidation step was omitted, while FIG. 4 shows results of such measurements for a cathode as described in the article referred to in the opening paragraph, in both cases at a cathode-anode gap of 0.3 mm.

It appears from the FIGS. that there is a clear improvement in a cathode subjected to the oxidation step according to the invention. Curve 2 in FIG. 2 does not begin to deviate from curve 1 until the emission j is approximately 40$^A$/cm$^2$, while curve 2' already begins to deviate from curve 1 at approximately 7.5$^A$/cm$^2$ (see an emission j of FIG. 3). The deviation is also much less at higher emission values (deviation −8% at 100$^A$/cm$^2$, FIG. 2) for a cathode according to the invention than for a cathode in which the oxidation step was not used (deviation already approximately −30% at 80$^A$/cm$^2$, FIG. 3). Moreover, the deviation is less (recovery is better) than in a cathode with a top layer as described in the article referred to in the opening paragraph (FIG. 4) Deviation of curve 2 from curve 1'' begins at 8.5$^A$/cm$^2$ and deviation is −15% at 80$^A$/cm$^2$.

As stated in the opening paragraph, the oxidation step may also precede the pressing operation. The pressure used is a critical parameter, which is illustrated in Table I in which the emission recovery after ion bombardment and surface scandium are shown for cathodes, prepared at two different pressures. Surfaces scandium was the result of Auger measurements carried out as described in the article previously referred to.

The cathode body associated with column A was obtained by pressing and subsequent sintering of a mixture of tungsten powder and 0.7% by weight of scandium powder, surrounded by a scandium oxide film (obtained by oxidizing heating of $ScH_2$ in wet argon). Pressing took place at a pressure of 1840$^N$/mm$^2$, and sintering took place in a hydrogen atmosphere at 1500° C.

The cathode body associated with column B was manufactured in the same manner but at a pressure of 920$^N$/mm$^2$ to.

Table I shows the variation of the emission after repeated ion bombardment (30 minutes) and reactivation (120 minutes at 950° C., 60 minutes at 1050° C., 1 night at 1050° C.). The measurements took place at a cathode temperature of 950° C., at 1000V. and a cathode-anode gap of 0.25 mm. The initial emission (100% level) was 90$^A$/cm$^2$ (A) and 96$^A$/cm$^2$ (B), respectively.

TABLE I

| | A | | B | |
|---|---|---|---|---|
| | Emission | Auger measurement* $pp^h(Sc)/pp^h(W)$ | Emission | Auger measurement* $pp^h(Sc)/pp^h(W)$ |
| after activation | 100% (90$^A$/cm$^2$) | 4.93 | 100% (96$^A$/cm$^2$) | 4.68 |
| 30 min. ion bombardment | | 0.27 | | 0.10 |
| 120 min. at T = 950° C. | 42% | 0.48 | 47% | 0.42 |
| 60 min. at T = 1050° C. | 52% | 0.55 | 64% | 0.65 |
| 1 night at T = 1050° C. | 70% | 0.44 | 91% | 1.27 |
| 30 min. ion bombardment | | 0.21 | | 0.09 |
| 120 min. at T = 950° C. | 38% | 0.26 | 56% | 0.33 |
| 60 min. at T = 1050° C. | 34% | 0.29 | 69% | 0.53 |
| 1 night at T = 1050° C. | 49% | 0.32 | 88% | 0.90 |

*$pp^h$ = peak-to-peak height
see "Properties and manufacture of top-layer scandate cathodes" Applied Surface Science 26 (1986), pag. 173-195 (J. Hasker et al)

Table I shows that the cathode in case A has a poor recovery because too large a pressure is used so that the oxide films are broken and the above-described mechanism (supply by means of diffusion) is no longer active.

Table II shows similar measurements on a cathode of the invention in which increasing the recovery temperature to T=1050° C. results in up to a 90% recovery of the initial emission of 105 A/cm$^2$ after only two hours, and repeated recovery up to 90% after repeated ion bombardment, in contrast to known scandate cathodes.

TABLE II

| | Emission | Auger measurement $pp^h(SC)/pp^h(W)$ |
|---|---|---|
| After activation | 100% (105$^A$/cm$^2$) | 5.2 |
| 30 min. ion bombardment | | 0.2 |
| 120 min. at T = 950° C. | 75% | 1.1 |
| 60 min. at T = 1050° C. | 86% | |
| 120 min. at T = 1050° C. | 90% | 1.4 |

TABLE II-continued

| | Emission | Auger measurement $pp^h(SC)/pp^h(W)$ |
|---|---|---|
| 30 min. ion bombardment | | 0.2 |
| 120 min. at T = 950° C. | 67% | 0.6 |
| 60 min. at T = 1050° C. | 77% | |
| 1 night at T = 1050° C. | 90% | 1.4 |
| 30 min. ion bombardment | | |
| 120 min. at T = 950° C. | 67% | 0.6 |
| 60 min. at T = 1050° C. | 75% | 0.7 |
| 1 night at T = 1050° C. | 89% | 1.0 |

In another cathode according to the invention the cathode body 11 with a diameter of 1.8 mm and a thickness of approximately 0.5 mm is obtained by pressing a mixture of tungsten powder, approximately 1% by weight of scandium powder and 7% by weight of barium-calcium-aluminate powder ($4BaO\text{-}1CaO\text{-}1Al_2O_3$) and subsequently sintering at 1050° C. in a hydrogen atmosphere. The cathode body, which may or may not have a molybdenum envelope 31, is welded onto the cathode shaft 41. The shaft 41 accommodates a helical filament 51 which may consist of a helically wound metal core 61 with an aluminium oxide insulation layer 71. At a cathode temperature of 950° C., the measured emission after activation was approximately $10^4/cm^2$. An advantage of this cathode is its simple method of manufacturing: impregnation and cleaning is not necessary. Auger measurements have shown that the formation of the scandium grains with an oxide film takes place during sintering via the aluminate.

The invention is of course not limited to the embodiments shown, as those skilled in the art can conceive of several variations within the scope of the invention. For example, the grains may also be present in the starting material, while scandium hydride may also be chosen as a starting material. The emissive material may be present in a storage chamber under the actual matrix (L cathode).

The cathodes according to the invention may be used in electron tubes for television applications and electron microscopy, but also in, for example magnetrons, transmitter tubes etc.

We claim:

1. A method of manufacturing a scandate cathode having a cathode body which comprises a matrix of at least a high-melting point metal and/or alloy and having an emissive surface with a barium compound at least on contact with the matrix material, which compound can supply barium to the emissive surface by a chemical reaction with the matrix material and the cathode body having a top layer comprising scandium coated with a scandium oxide film, said method comprising pressing the matrix from a powder of the high-melting point metal and/or alloy and a powder of a scandium providing material selected from the group consisting of scandium and scandium hydroxide, partially oxidizing the powder of the scandium providing material and then sintering the resultant assembly and impregnating the resultant sintered assembly wit the barium compound.

2. A method of manufacturing a scandate cathode having a cathode body which comprises a matrix of at least a high-melting point metal and/or alloy and having an emissive surface with a barium compound at least on contact with the matrix material, which compound can supply barium to the emissive surface by a chemical reaction with the matrix material and the cathode body having a top layer comprising scandium coated with a scandium oxide film, said method comprising pressing the matrix from a powder of the high-melting point metal and/or alloy and a powder of scandium coated with a scandium oxide film and then sintering the resultant assembly and impregnating the resultant sintered assembly with the barium compound.

3. A method of manufacturing a scandate cathode having a cathode body which comprises a matrix of at least a high-melting point metal and/or alloy and having an emissive surface with a barium compound at least on contact with the matrix material, which compound can supply barium to the emissive surface by a chemical reaction with the matrix material and the cathode body having a top layer comprising scandium coated with a scandium oxide film, said method comprising mixing powders of a high-melting point metal and/or alloy, a member selected from the group consisting of scandium oxide film coated scandium and scandium oxide film coated scandium hydride and a barium compound which can supply barium to the emissive surface by a chemical reaction with the high-melting point metal and/or alloy during operation of the cathode, pressing the mixture and sintering the resultant pressed mixture.

4. A method as claimed in claim 1, characterized in that the weight increase due to the oxidation is 5–30% of the weight of the scandium.

5. A method as claimed in claim 4, characterized in that the sintering operation is performed in hydrogen at a temperature of at most 1500° C.

6. A method as claimed in claim 1, characterized in that the sintering operation is performed in hydrogen at a temperature of at most 1500° C.

7. A method as claimed in claim 1, characterized in that the powder from which the matrix is pressed comprises a maximum quantity of 2.5% by weight of scandium or scandium hydride.

8. A method as claimed in claim 1, characterized in that the sintering operation is performed in hydrogen at a temperature of at most 1500° C.

9. A method as claimed in claim 1, characterized in that the powder from which the matrix is pressed comprises a maximum quantity of 2.5% by weight of scandium or scandium hydride.

10. A method of manufacturing a cathode as claimed in claim 2, characterized in that the scandium oxide is obtained by oxidation of scandium or scandium hydride.

11. A method as claimed in claim 10, characterized in that the sintering operation is performed in hydrogen at a temperature of at most 1500° C.

12. A method as claimed in claim 10, characterized in that the weight increase due to the oxidation is 5–30% of the weight of the scandium.

13. A method as claimed in claim 2, characterized in that the weight increase due to the oxidation is 5–30% of the weight of the scandium.

14. A method as claimed in claim 2, characterized in that the sintering operation is performed in hydrogen at a temperature of at most 1500° C.

15. A method as claimed in claim 2, characterized in that the powder from which the matrix is pressed comprises a maximum quantity of 2.5% by weight of scandium or scandium hydride.

* * * * *